US008243006B2

(12) United States Patent
Sarma et al.

(10) Patent No.: US 8,243,006 B2
(45) Date of Patent: Aug. 14, 2012

(54) METHOD AND SYSTEMS FOR IMPROVING PERFORMANCE IN A FIELD SEQUENTIAL COLOR DISPLAY

(75) Inventors: Kalluri R. Sarma, Mesa, AZ (US); John F. L. Schmidt, Phoenix, AZ (US); Dennis M. Davey, Glendale, AZ (US)

(73) Assignee: Honeywell International Inc., Morristown, NJ (US)

( * ) Notice: Subject to any disclaimer, the term of this patent is extended or adjusted under 35 U.S.C. 154(b) by 1278 days.

(21) Appl. No.: 11/941,661

(22) Filed: Nov. 16, 2007

(65) Prior Publication Data

US 2009/0128543 A1 May 21, 2009

(51) Int. Cl.
*G09G 3/36* (2006.01)

(52) U.S. Cl. ..... 345/102; 345/88

(58) Field of Classification Search ..... 345/102, 345/82, 83, 88; 349/61
See application file for complete search history.

(56) References Cited

U.S. PATENT DOCUMENTS

| | | | |
|---|---|---|---|
| 4,875,091 | A | 10/1989 | Yamada et al. |
| 5,668,572 | A | 9/1997 | Meyer et al. |
| 5,680,180 | A | 10/1997 | Huang |
| 6,115,016 | A | 9/2000 | Yoshihara et al. |
| 6,392,656 | B1 | 5/2002 | Someya et al. |
| 6,419,365 | B1 | 7/2002 | Potekev et al. |
| 6,570,554 | B1 | 5/2003 | Makino et al. |
| 6,791,527 | B2 | 9/2004 | Yoshinaga et al. |
| 6,803,894 | B1 | 10/2004 | Hirota et al. |
| 6,831,621 | B2 | 12/2004 | Nakano |
| 7,053,880 | B2 | 5/2006 | Lim et al. |
| 7,116,378 | B1 | 10/2006 | McDonald |
| 7,161,571 | B2 | 1/2007 | Nally et al. |
| 7,170,482 | B2 | 1/2007 | Okita |
| 7,248,244 | B2 | 7/2007 | Akiyama |
| 2005/0116922 | A1 | 6/2005 | Kim |
| 2005/0134782 | A1 | 6/2005 | Park et al. |
| 2005/0231453 | A1 | 10/2005 | Park et al. |
| 2005/0231496 | A1 | 10/2005 | Kim et al. |
| 2006/0152534 | A1 | 7/2006 | Chang et al. |
| 2007/0120810 | A1 | 5/2007 | You et al. |

*Primary Examiner* — Regina Liang
(74) *Attorney, Agent, or Firm* — Ingrassia Fisher & Lorenz, P.C.

(57) ABSTRACT

Methods and systems for displaying an image on a display device having first and second light sources are provided. A video signal is provided to the display device. The video signal includes a plurality of frames, and each frame includes first and second sub-frames corresponding to the respective first and second light sources. The first light source is operated for a first duration during the first sub-frame of each of the plurality of frames. The second light source is operated for a second duration during the second sub-frame of each of the plurality of frames. The second duration is different than the first duration.

17 Claims, 9 Drawing Sheets

METHOD AND SYSTEMS FOR IMPROVING PERFORMANCE IN A FIELD SEQUENTIAL COLOR DISPLAY

TECHNICAL FIELD

The present invention generally relates to display devices, and more particularly relates to methods and systems for improving performance in field sequential color (FSC) display devices.

BACKGROUND

In recent years, liquid crystal displays (LCDs), and other flat panel display devices, have become increasingly popular as mechanisms for displaying information to operators of vehicles, such as aircraft. One of the reasons for this is that LCDs are capable of providing very bright and clear images that are easily seen by the user, even in high ambient light situations, such as daytime flight.

Conventional active matrix (AM) LCDs use spatial averaging of the pixels to generate full color from three different colors (e.g., red, green, and blue (RGB)) of light emitters, such as light emitting diodes (LEDs), along with an array of color filters. However, approximately two-thirds of the available backlight power is often absorbed by a color filter array which significantly impairs power efficiency. This loss of power efficiency leads to thermal management being a significant issue in conventional LCD displays for applications requiring high display luminance.

Recently, field sequential color (FSC) displays have been developed for use with various image sources, such as LCDs, cathode ray tubes (CRTs), liquid crystal on silicon (LCOS), and digital micro-mirrors (DMMs). FSC displays do not use color filters and yet generate full color by sequentially writing each pixel in the display in conjunction with sequentially switching RGB emitters in the backlight. Full color is generated at each pixel by temporally averaging the RGB emissions of each pixel. Because color filters are not required, the power consumption is greatly reduced, which often eliminates the need for active cooling of the display in high luminance applications. Additionally, display resolution is effectively tripled when compared with conventional LCDs, as full color may be generated at each individual pixel, rather than using multiple pixels in combination.

However, there still are several limitations to FSC displays, such as FSC LCDs, with respect to maximizing luminance and a propensity for color breakup that adversely affects image quality. In a conventional FSC LCD, each video frame is subdivided into three equal sub-frames, each for refreshing the display with one of the RGB data. Thus, a 60 Hertz (Hz) video refresh rate used in a conventional RGB pixel LCD leads to a 180 Hz refresh rate for an FSC LCD. The RGB LED backlight operation is synchronized with writing the RGB data for the FSC LCD and, in order to avoid unintentional color mixing from one sub-frame to the next, the duty cycle of the RGB emitters has to be reduced to much less than the sub-frame period. The RGB emitters are turned "on" only after all the rows in the display are addressed and the pixels have switched to the demanded state, which reduces the duty cycle of the LED emitters to as low as, for example, 20% of the sub-frame time. This in turn reduces the maximum achievable display luminance using a given RGB backlight. Furthermore, to reduce color breakup in FSC LCDs, the refresh rate is often increased to, for example, 240 Hz, further restricting the duty cycles of the RGB emitters in the backlight, and thus the maximum achievable display luminance.

Accordingly, it is desirable to provide a method and system for improving performance in a FSC display device, such as increasing display luminance and power efficiency and decreasing color breakup. Furthermore, other desirable features and characteristics of the present invention will become apparent from the subsequent detailed description of the invention and the appended claims, taken in conjunction with the accompanying drawings and this background of the invention.

BRIEF SUMMARY

A method for displaying an image on a display device having first and second light sources is provided. A video signal is provided to the display device. The video signal includes a plurality of frames, and each frame includes first and second sub-frames corresponding to the respective first and second light sources. The first light source is operated for a first duration during the first sub-frame of each of the plurality of frames. The second light source is operated for a second duration during the second sub-frame of each of the plurality of frames. The second duration is different than the first duration.

A method for displaying an image on a display device having first, second, and third light emitters and an imaging device is provided. A video signal is provided to the display device. The video signal includes a plurality of frames, and each frame includes first, second, and third sub-frames corresponding to the respective first, second, and third light emitters. The first light emitter is operated for a first duration during the first sub-frame of each of the plurality of frames. The second light emitter is operated for a second duration during the second sub-frame of each of the plurality of frames. The second duration is different than the first duration. The third light emitter is operated for a third duration during the third sub-frame of each of the plurality of frames. The third duration is different than the first and second durations. An image is generated with the light emitted from the first, second, and third light emitters during the respective first, second, and third durations with the imaging device.

A display device system is provided. The display device system includes a backlight comprising first and second light emitters, an image source coupled to the backlight and configured to generate an image with light emitted from the first and second light emitters, and a controller coupled to the backlight and the image source. The controller is configured to provide a video signal to the backlight and the image source. The video signal includes a plurality of frames, each frame comprising first and second sub-frames corresponding to the respective first and second light emitters of the backlight. The controller is further configured to operate the first light emitter for a first duration during the first sub-frame of each of the plurality of frames and operate the second light emitter for a second duration during the second sub-frame of each of the plurality of frames. The second duration is different than the first duration.

BRIEF DESCRIPTION OF THE DRAWINGS

The present invention will hereinafter be described in conjunction with the following drawing figures, wherein like numerals denote like elements.

DETAILED DESCRIPTION

The following detailed description is merely exemplary in nature and is not intended to limit the invention or the application and uses of the invention. Furthermore, there is no intention to be bound by any expressed or implied theory presented in the preceding technical field, background, and brief summary or the following detailed description. It should also be noted that FIGS. 1-9 are merely illustrative and may not be drawn to scale.

FIG. 1 to FIG. 9 illustrate a method and system for displaying an image on a display device having first and second light sources (e.g., multiple colors of light emitting diodes (LEDs)). A video signal is provided to the display device. The video signal includes a plurality of frames, and each frame includes first and second sub-frames corresponding to the respective first and second light sources. The first light source is operated for a first duration during the first sub-frame of each of the plurality of frames. The second light source is operated for a second duration during the second sub-frame of each of the plurality of frames. The second duration is different than the first duration.

Exemplary embodiments of the invention also provide a display comprising a FSC backlight coupled to a FSC LCD module. Furthermore, the backlight system controller receives and processes brightness data for red, green, and blue light emitters, and video timing signals that synchronize FSC backlight operation with FSC LCD operation. Furthermore, the backlight system controller may be implemented using a plurality of digital controls, including field programmable gate arrays (FPGAs), application specific integrated circuits (ASICs), discrete logic, microprocessors, microcontrollers, and digital signal processors (DSPs), or combinations thereof.

Figure 1:
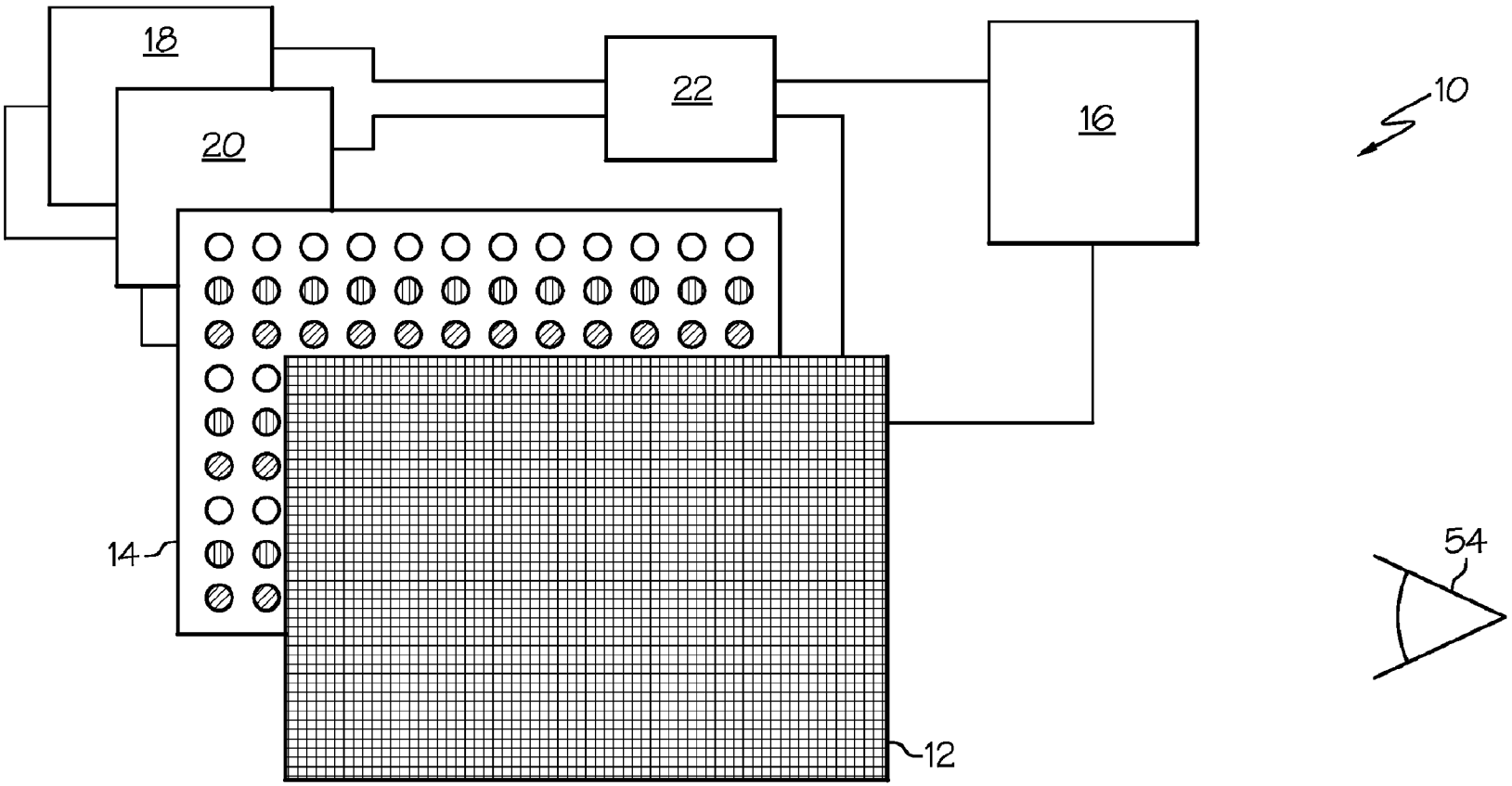
FIG. 1 is a schematic plan view of a field sequential color (FSC) display system according to one embodiment of the present invention.

FIG. 1 schematically illustrates a field sequential color (FSC) display system 10, according to one embodiment of the present invention. The FSC system 10 includes a liquid crystal display (LCD) panel 12, a FSC backlight 14, a LCD system controller 16, a backlight subsystem controller 18, a backlight power controller 20, and a power supply 22.

Figure 2:
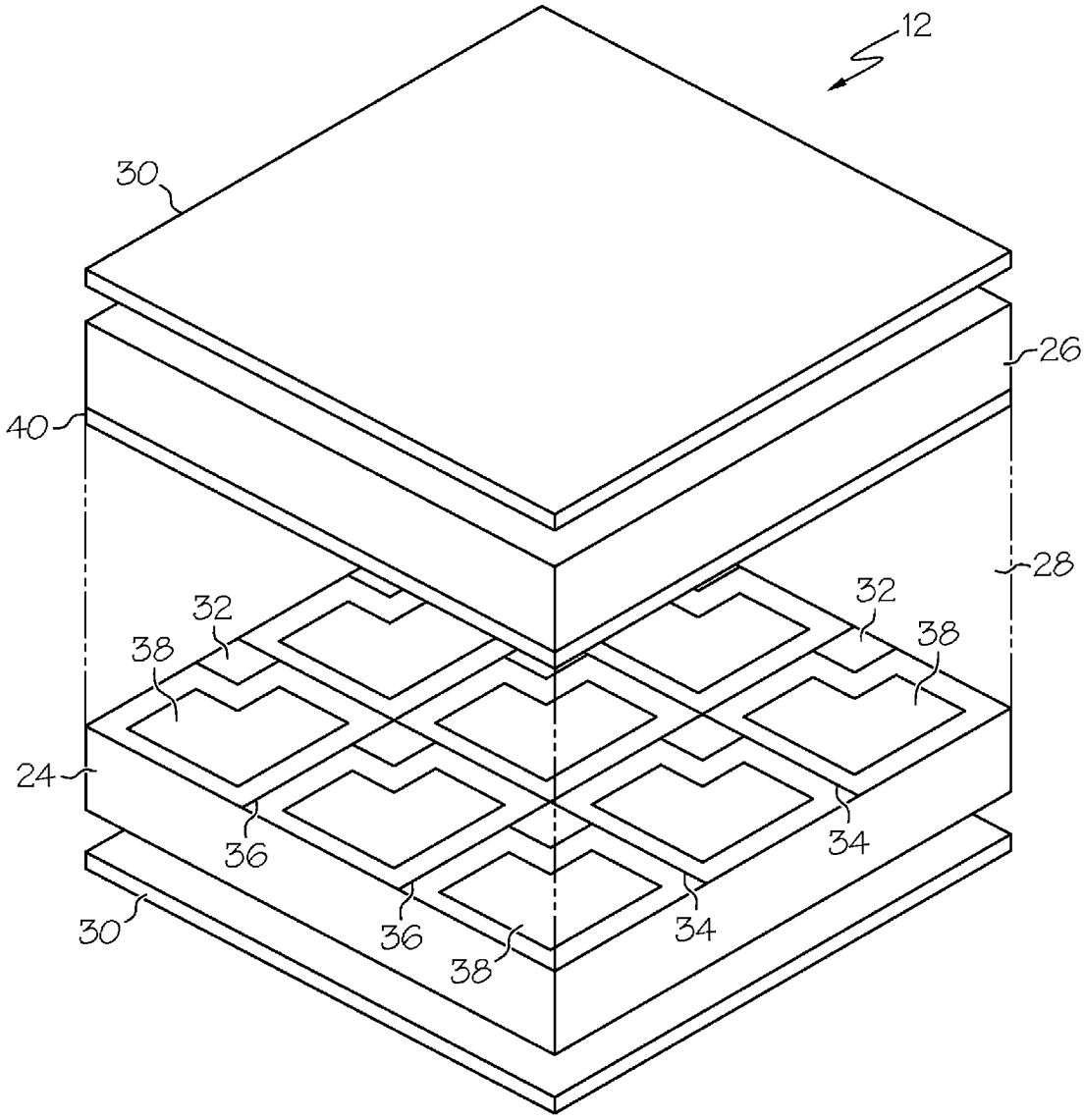
FIG. 2 is a cross-sectional isometric view of a portion of a LCD panel within the display system of FIG. 1.

The LCD panel 12 is in operable communication with the LCD system controller 16 and the power supply 22. FIG. 2 illustrates a portion of the LCD panel 12, according to one embodiment of the present invention. The LCD panel 12 is, in one embodiment, a thin film transistor (TFT) LCD panel and includes a lower substrate 24, an upper substrate 26, a liquid crystal layer 28, and polarizers 30. As will be appreciated by one skilled in the art, the lower substrate 24 may be made of glass and have a plurality of TFT transistors 32 formed thereon, including a plurality of gate electrodes 34 (i.e., row lines), including a plurality of rows of electrodes, and source electrodes 36 (i.e., column lines), including a plurality of columns of electrodes, interconnecting respective rows and columns of the transistors 32. The gate and source electrodes 34 and 36 divide the lower substrate 24 into a plurality of display pixels 38, as is commonly understood. The upper substrate 26 may also be made of glass and includes a common electrode 40 at a lower portion thereof. It should be noted that, at least in one embodiment, the LCD panel 12 does not include a color filter array layer. The common electrode 40 may substantially extend across the upper substrate 26. The liquid crystal layer 28 may be positioned between the lower substrate 24 and the upper substrate 28 and includes a liquid crystal material suitable for use in a FSC LCD display. As shown, the LCD panel 12 includes two polarizers 30, with one being positioned below the lower substrate 24 and one above the upper substrate 26. Although not illustrated, the polarizers 30 may be oriented such that the LCD panel operates in a normally white mode.

Figure 3:
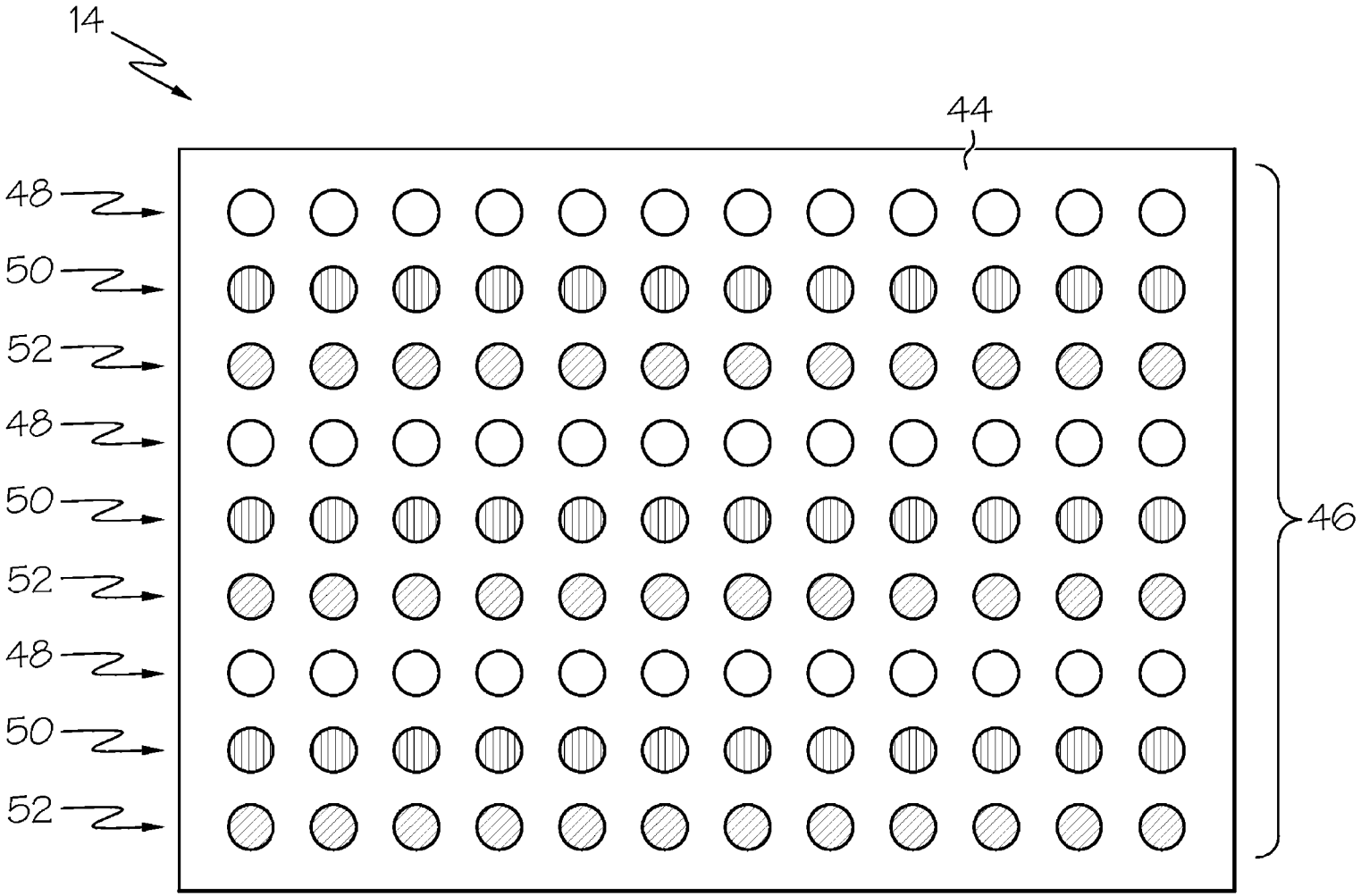
FIG. 3 is a plan view of a backlight within the display system of FIG. 1.

Referring again to FIG. 1, the backlight 14 is placed proximate to the LCD panel 12 and is in operable communication with the backlight power controller 20. FIG. 3 illustrates the backlight 14 in greater detail. In one embodiment, the backlight 14 is a light emitting diode (LED) panel which includes a support substrate 44 with an array of LEDs (e.g., RGB LEDs) 46 mounted thereto. In one embodiment, the LEDs 46 includes rows of red LEDs 48, rows of green LEDs 50, and rows of blue LEDs 52. Although the LEDs 46 shown in FIG. 3 are arranged in a 12×9 array, for a total of 108 LEDs, it should be understood that the backlight 14 may include fewer or considerably more LEDs, such as over 1000. As is commonly understood, the red LEDs 48 emitted red light with a frequency between (or in a frequency band), for example, 430 and 480 terahertz (THz). The green LEDs 50 emit light with a frequency between, for example, 540 and 610 THz. The blue LEDs 52 emit light with a frequency between, for example, 610 and 670 THz. It will be appreciated by one skilled in the art that the exact performance characteristics, or radiant properties, (e.g., frequency, brightness, emission angle, etc.) of the LEDs 46, and thus the backlight 14 as a whole, may vary depending on the manufacturer of the LEDs 46, as well as manufacturing variations experienced by a single manufacturer. These variations in performance characteristics, however, may be determined using techniques well known in the art (e.g., optical testing). The differences in the radiant properties of the LEDs may then be utilized in optimizing the performance of the display system as described below.

Referring again to FIG. 1, the LCD system controller 16, the backlight subsystem controller 18, the backlight power controller 20, and the power supply 22 are in operable communication and/or electrically connected as shown. In one embodiment, the controllers 16, 18, and 20 include electronic components, including various circuitry and/or integrated circuits, such as field programmable gate arrays (FPGAs), application specific integrated circuits (ASICs), discrete logic, microprocessors, microcontrollers, and digital signal processors (DSPs), and/or instructions stored on a computer readable media to be carried out by the circuitry to individually or jointly perform the methods and processes described below. The LCD system controller 16, the backlight subsystem controller 18, and the backlight power controller 20 may thus jointly form a processing or control system.

During operation, the LCD system controller 16 provides video data, or a video signal, to the LCD panel 12 in the form of color and brightness. In one embodiment, and in accordance with FSC display operation, the video data is applied in sequential frames (full or partial video frames), with each frame including multiple (e.g., three) sub-frames, each corresponding only to a particular color (e.g., red, green, or blue). For example, the first sub-frame includes only red data for each display pixel 38 (FIG. 2), the second sub-frame includes only green data for each display pixel 38, and the third sub-frame includes only blue data for each display pixel 38. The three sequentially applied video sub-frames are temporally averaged by a viewer's eye 54 to produce the proper mix of red, green, and blue for each displayed pixel 38 on the LCD panel 12.

The LCD system controller 16 provides a synchronization signal to the backlight subsystem controller 18 to ensure that the red video sub-frame provided by the LCD system controller 16 is synchronized with the activation of the red LEDs 48 (FIG. 3). In a similar fashion, the LCD system controller 16 provides synchronization signals to the backlight subsystem controller 18 to ensure that the green video sub-frame and the blue video sub-frame provided by the LCD system controller 16 are synchronized with the activation of the respective green LEDs 50 and blue LEDs 52.

Referring to FIG. 2, a time varying voltage is applied across each pixel 38 that dictates the amount of movement (tilting, twisting, etc.) exhibited by the liquid crystal molecules located in the liquid crystal layer 28 to control the amount of light which passes through the LCD panel 12. As such, the LCD panel 12 modulates the light passing therethrough in such a way that information (e.g., in the form of images, text, symbols, etc.) is displayed to the viewer's eye 54.

The LCD system controller 16 provides an image synchronization signal to the backlight subsystem controller 18, which may occur at one-third of the sub-frame rate, at the sub-frame rate, or at an alternate rate which ensures synchronized operation between the LCD panel 12 and the backlight 14, depending upon the point of origin for the image synchronization signal. For example, if the sub-frame rate is 180 Hz, then the image synchronization signal may be provided at 60 Hz or 180 Hz.

Figure 4:
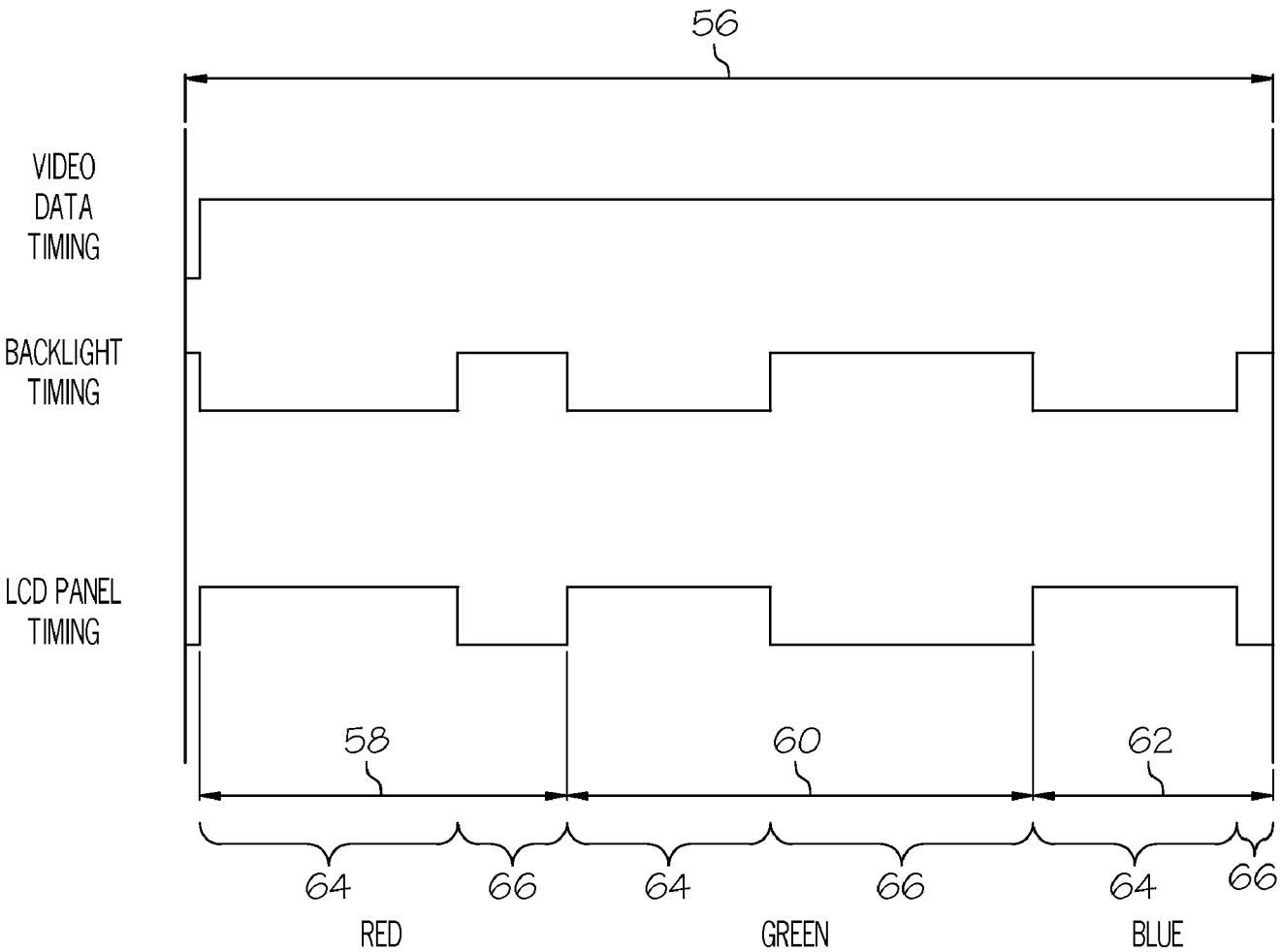
FIG. 4 is temporal view illustrating the operation of the display system of FIG. 1 in accordance with one embodiment of the present invention.

FIG. 4 temporally illustrates operation of the backlight 14 in conjunction with the LCD panel 12, according to one embodiment. Although only one frame is shown, the operation is divided into frames 56, each of which includes a red sub-frame 58, a green sub-frame 60, and a blue sub-frame 62. According to one aspect of the present invention, the sub-frames 58, 60, and 62 have asymmetric times (i.e., unequal durations), and the frame times for each color sub-frame is optimized and uniquely specified. The duration for frame 56 equals the sum of the durations for the sub-frames 58, 60 and 62 and may be similar to conventional times (e.g., 16.6667 ms for 60 Hz operation). In the example shown in FIG. 4, the red sub-frame 58 has been increased (e.g., to 6.5556 ms), the green sub-frame 60 has been increased (e.g., to 7.5556 ms), and the blue sub-frame 62 has been decreased (e.g., to 2.5556 ms) when compared to sub-frame times of conventional systems. As shown in FIG. 4, each of the sub-frames 58, 60, and 62 include inactive portions 64 and active portions 66. As will be appreciated by one skilled in the art, during the inactive portions 64, none of the LEDs 46 on the backlight 14 are operated and the gate and source electrodes 34 and 36 (FIG. 2) are configured (i.e., "written") to apply appropriate voltages to the pixels 38. During the active portions 66 of each of the sub-frames 58, 60, and 62, the respective color of LEDs 46 (e.g., red LEDs 48, green LEDs 50, or blue LEDs 52) are activated while the pixels 38 are appropriately configured to selectively block the light emitted by the LEDs 46.

Thus, within a single frame 56, the operation of the backlight 14 and the LCD panel 12 includes configuring the pixels 38 three times (i.e., once for each of the colors of LEDs) and emitting light through the LCD panel 12 three times (i.e., each of the colors of LEDs being activated once). During the red sub-frame 58, the pixels 38 are appropriately configured for red light within the inactive portion 64, and the red LEDs 48 are operated within the active portion 66. During the green sub-frame 60, the pixels 38 are appropriately reconfigured for green light within the inactive portion 64, and the green LEDs 50 are operated within the active portion 66. During the blue sub-frame 62, the pixels 38 are again appropriately reconfigured for blue light within the inactive portion 64, and the blue LEDs 52 are operated within the active portion 66.

In the depicted embodiment, the time required to configure the pixels 38, or the inactive portions 64 (i.e., LCD data address time period), for each color (or within each sub-frame 58, 60, and 62) is approximately the same (as it involves using the same active matrix LCD for each color). However, as shown, the active portions 66 of the sub-frames 58, 60, and 62 differ considerably. That is, although the time taken to configure the pixels 38 is approximately the same in each sub-frame 58, 60, and 62, the "on-time" for each color is unique. This asymmetry results in the differing durations of the sub-frames 58, 60, and 62 as described above.

The on-times for each color (and thus the sub-frame durations) are optimized based on the required luminance from each of the colors and the relative performance characteristics (i.e., differences in radiant properties) of the individual emitters as described above, as well as perception of the different colors of light by the viewer's eye 54. For example, when the blue luminance requirement is low, the blue LEDs 52 backlight duty cycle, and thus the blue sub-frame 62 time, is decreased in relation to the green sub-frame 60 time and the red sub-frame 58 time. Increasing the on-times for the green and red LEDs 48 and 50 by increasing their duty cycle (and thus increasing their sub-frame times) increases the display luminance for those colors.

One advantage is that display luminance may be increased by as much as 33% compared to a conventional FSC LCD module. In addition to increasing the display luminance, this asymmetric sub-frame operation also allows operation of the FSC LCD system under conditions where the RGB emitters operate more efficiently, thereby reducing the display power consumption. Another advantage is the reduction of the propensity for color breakup image artifact, thereby increasing the image quality of the display. By selectively increasing the duty cycle of the green and red emitters which have higher photopic sensitivity than the blue emitter, the separation between the green-to-green and red-to-red is decreased during saccadic movements, which in turn reduces the propensity for color break-up artifact.

Figure 5:
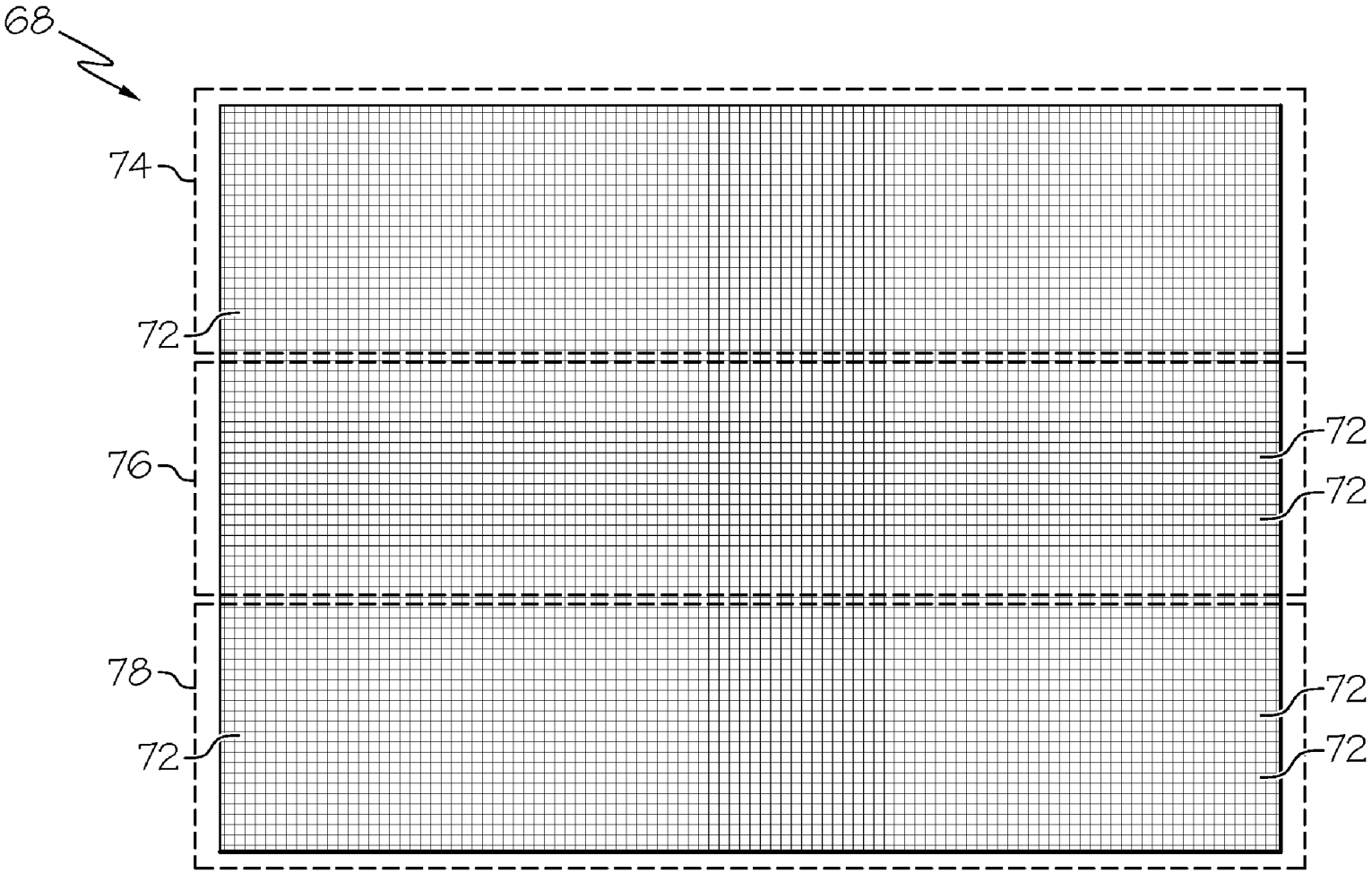
FIG. 5 is a plan view of a liquid crystal display (LCD) panel according to another embodiment of the present invention.
Figure 6:
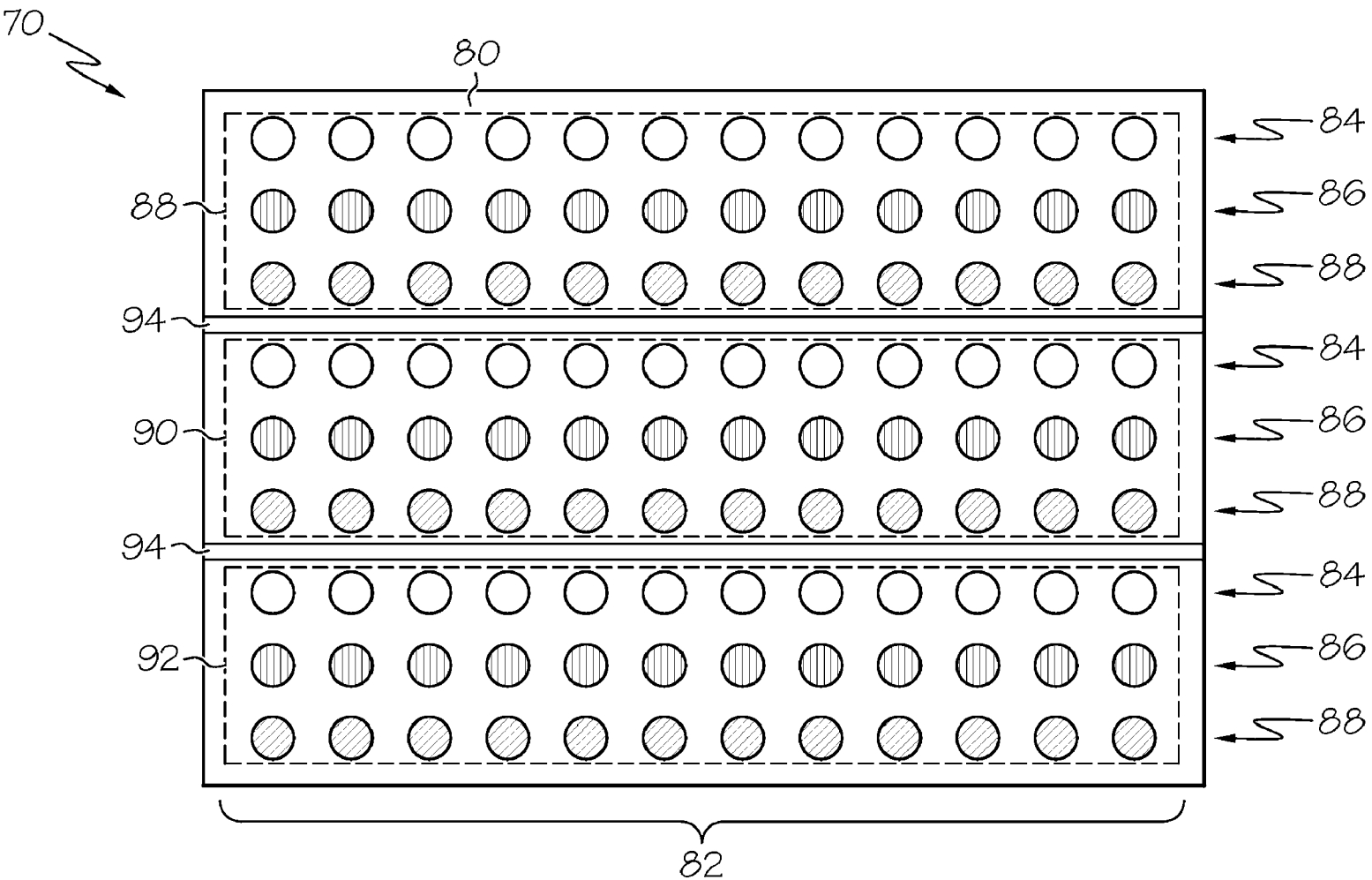
FIG. 6 is a plan view of a backlight for use in conjunction with the LCD panel of FIG. 5.

FIGS. 5 and 6 illustrate a LCD panel 68 and a backlight 70 according to another embodiment of the present invention. The embodiment shown in FIGS. 5 and 6 uses multiple, independently controllable backlight zones in conjunction with the asymmetric sub-frame time mode of operation. The backlight zones are arranged perpendicular to the row scan direction (i.e., parallel to the gate lines 34 in the LCD panel 12 in FIG. 2). With multiple backlight zones, the RGB backlight behind the first zone can be turned "on" soon after the corresponding display region has been addressed and the LCD pixels have responded, without having to wait until the entire display has been addressed and has responded. As a result, the duty cycles of the RGB emitters may be increased which further increases display luminance.

Referring now to FIG. 5, the LCD panel 68 may be similar to that shown in FIGS. 1 and 2 and similarly includes a plurality of pixels 72. However, the pixels 72 are divided into an upper (or first) section (or zone) 74, a mid-section (or second section) 76, and a lower (or third) section 78. In one embodiment, the LCD panel 68 is scanned from top to bottom, just as in a conventional LCD. The predetermined number of multiple zones, or sections 74, 76, and 78, are defined by time boundaries during the scanning process. At these time boundaries for each zone, backlight operation is adjusted to maintain color synchronization with the applied LCD data.

As shown in FIG. 6, the backlight 70 may be similar to that shown in FIG. 3 and include a substrate 80 and a LED array 82 on the substrate 80 and arranged in red LED rows 84, green LED rows 86, and blue LED rows 88. Similar to the sections 74, 76, and 78 in FIG. 5, the LEDs 82 are divided into an upper group 88, a mid-group 90, and a lower group 92, each is activated separately, as described below. The backlight 70 also includes dividers 94 to block light from the LEDs 82 from crossing the boundaries of the groups 88, 90, and 92.

During operation the LCD panel 68 and the backlight 70 are arranged such that the upper, mid-, and lower sections 74, 76, and 78 of the LCD panel 68 are aligned with the respective upper, mid-, and lower groups 88, 90, and 92 of the backlight 70. The LCD panel 68 and the backlight 70 may be driven using similar signal to those depicted in FIG. 4. However, the illumination of the pixels 72 in the upper section 74 of the LCD panel 68 occurs before the illumination of the pixels 72 in the mid- and lower sections 76 and 78. That is, in the red sub-frame 58 (FIG. 4), once the pixels 72 in the upper section 74 of the LCD panel 68 have been written and configured (i.e., after the inactive portion 64 of the red sub-frame 58), the red LEDs 84 in the upper group 88 of the backlight 14 are activated (i.e., the active portion 66 of the red sub-frame 58). During the activation of the red LEDs 84 in the upper group 88, the pixels 72 in the mid-section 76 of the LCD panel 68 are written and configured. After the pixels 72 in the mid-section 76 of the LCD panel 68 are configured, the red LEDs 84 in the mid-group 90 of the backlight are activated.

Of particular interest in this embodiment is that the upper section 74 of the LCD panel 68 and the upper group 88 of the backlight 70 continue to carry out the operation as dictated by the green and blue sub-frames 60 and 62 while the other sections and groups are still operating under the red sub-frame 58.

Figure 7:
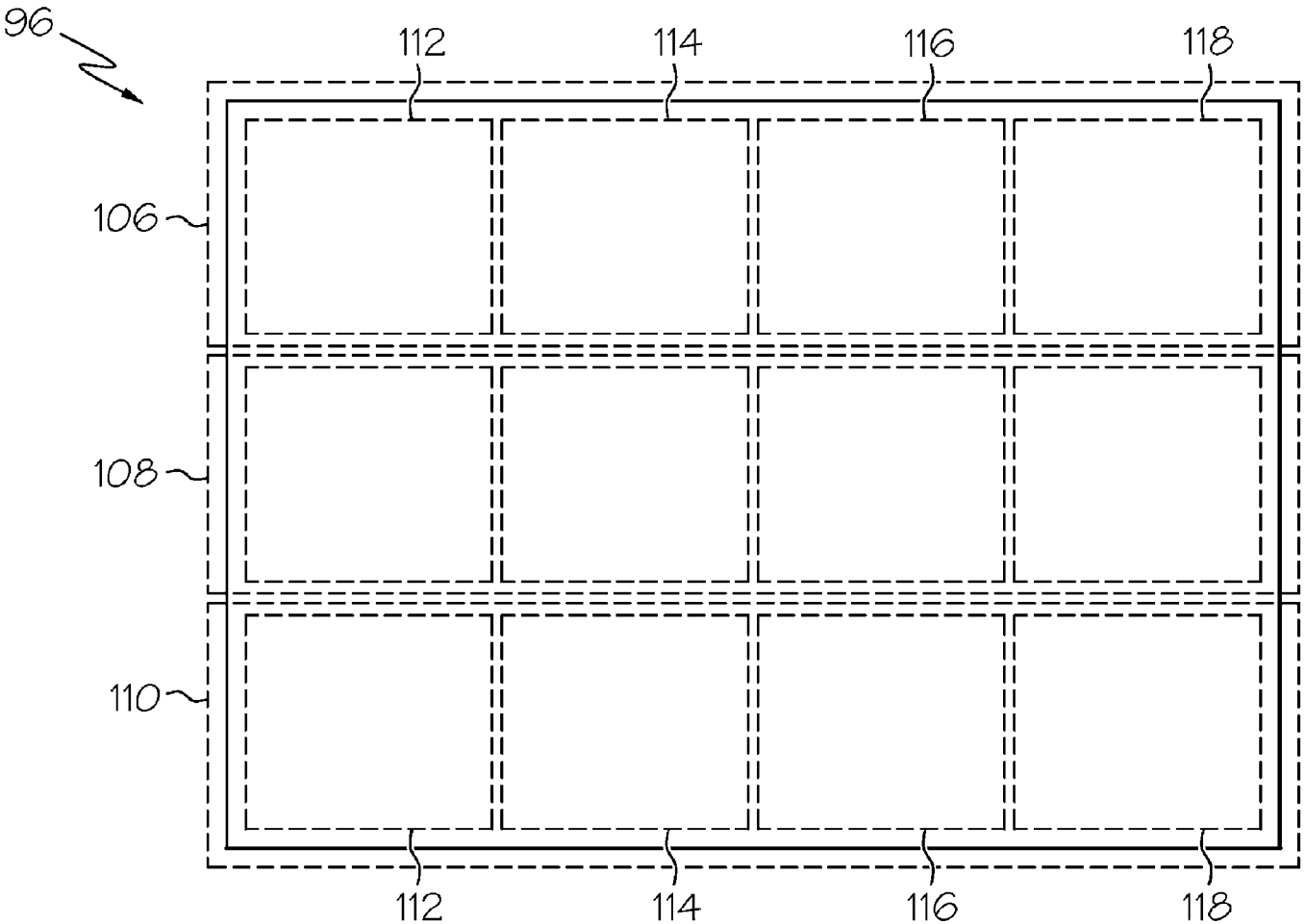
FIG. 7 is a plan view of a LCD panel according to a further embodiment of the present invention.
Figure 8:
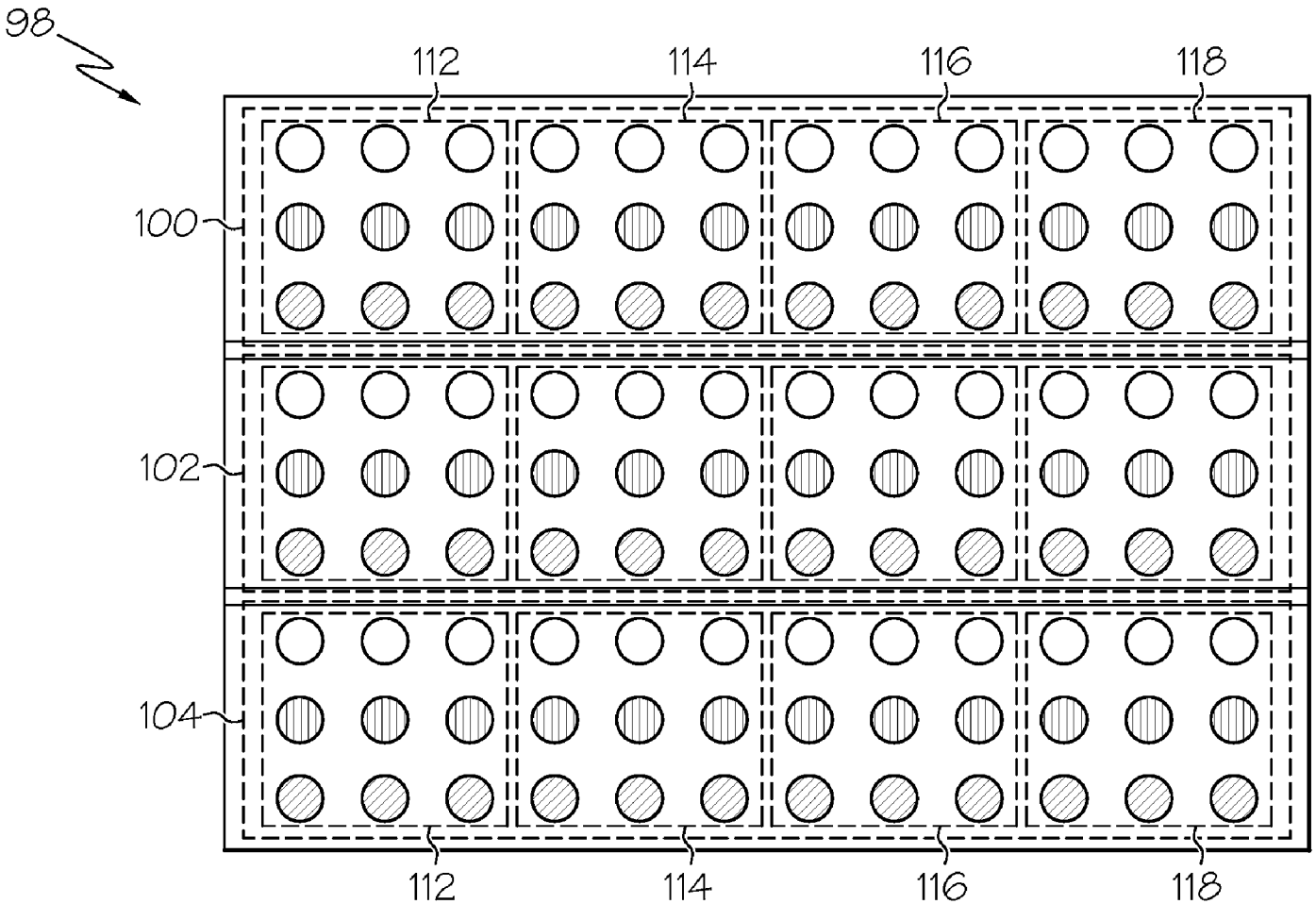
FIG. 8 is a plan view of a backlight for use in conjunction with the LCD panel of FIG. 7.

FIGS. 7 and 8 illustrate a LCD panel 96 and a backlight 98, respectively, according to another embodiment of the present invention. It should be noted that the pixels on the LED panel 96 are not shown for illustrative clarity. Similar to that shown in FIGS. 5 and 6, the embodiment of FIGS. 7 and 8 uses multiple, independently controllable backlight zones 100, 102, and 104 that correspond, respectively, to sections 106, 108, and 110 of the LCD panel 96. Each zone 100, 102, and 104 of the backlight 98 includes four independently controllable regions (or backlight portions) 112, 114, 116, and 118, the boundaries of which are shown in both FIGS. 7 and 8. As shown, the regions 112, 114, 116, and 118 of each of the backlight zones 100, 102, and 104 may be aligned with one of the sections 106, 108, and 110 of the LCD panel 96. In this embodiment, as with the embodiment shown in FIGS. 5 and 6, the backlight zones 100, 102, and 104 are arranged to be perpendicular to the row scan direction (i.e., parallel to the gate lines 34 in the LCD panel 12 in FIG. 2). Further, the R, G, B luminance values in each of the regions 112-118 in each zone 100-104 is individually controllable as the backlight zones are scanned for a FSC LCD with the asymmetric sub-frame time mode of operation.

With respect to construction, the LCD 96, may be similar to the one used in the previous embodiments. As with the embodiment shown in FIGS. 5 and 6, the number of zones 100-104 is defined by the time boundaries during the row scanning (or frame refreshing) process. At the boundaries for each zone 100-104, the backlight operation is adjusted to maintain color synchronization with the LCD data. The various regions of the LCD are illuminated by the corresponding regions of the backlight 98 with independent R, G, B luminance control. In actual operation, the RGB luminance values of each of the regions 112-118 in each of the zones 100-104 in the backlight 98 are computed from the image data to be presented in the LCD. The LED backlight regions 112-118 corresponding to brighter regions of the image (in the image data) are driven to higher luminance levels, and the LED backlight regions 112-118 corresponding to darker regions in the image data are driven to lower luminance levels. As a result, LCD off-axis light leakage is dramatically reduced for the low-graylevel pixels, and display contrast ratio is enhanced over broad viewing angles. Thus, the image quality of the display is improved.

The RGB luminance values for each region 112-118 of the LED backlight 98 are calculated from the image data to be displayed. In essence, the LED backlight 98 shown in FIG. 8 may be driven as a very low resolution display (e.g., with each of the twelve regions 112-118 corresponding to a "pixel") using the drive voltages computed from the image data to be displayed on the LCD. While FIGS. 7 and 8 show a display with three zones 100-104 and four regions 112-118 in each zone, the display may indeed be separated in to more or less zones and each zone in turn may be divided in to more or less independently controllable backlight regions. An additional advantage of this embodiment is that it allows for further power savings during display operation.

Other embodiments may utilize different numbers and arrangements of light sources (e.g. LEDs). The numbers and arrangements, along with the sizes and shapes of the LEDs may be varied. Additionally, the overall size and shape of the LCD panel (or other image source) used may be varied. For example, a LCD panel with a substantially rectangular shape may have a length of between 3 and 15 inches and a width of between 1.5 and 12 inches. Furthermore, although not described in detail, the backlight power controller 20 (or other control component of the system 10) may include a "dimming" function in which power to the LEDs is reduced for instances with lower luminance requirements, such as night-time operation.

Figure 9:
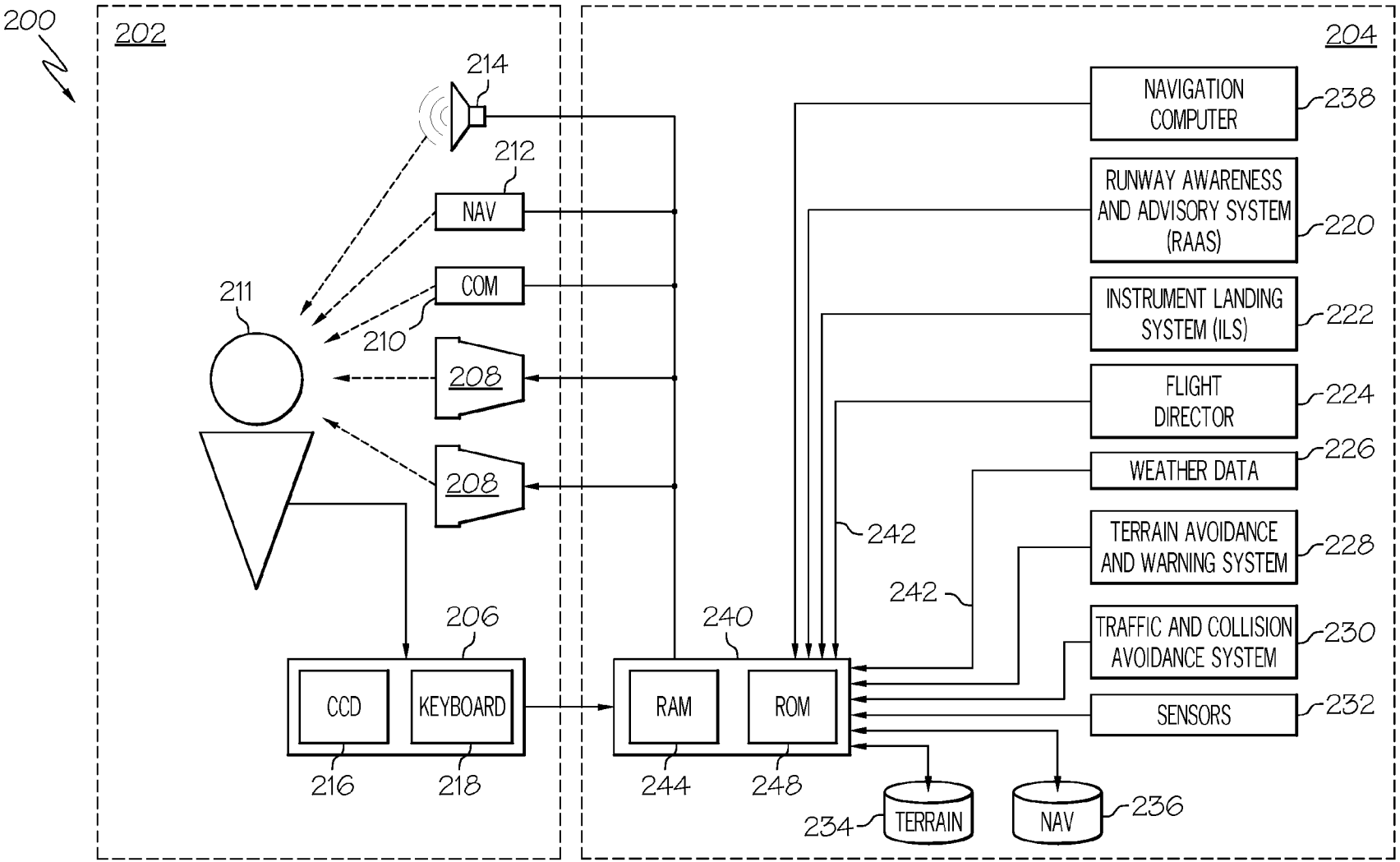
FIG. 9 is a schematic block diagram of a vehicle in which the display system of FIG. 1 may be implemented.

FIG. 9 schematically illustrates a vehicle 200, such as an aircraft, in which the display system 10 (FIG. 1) described above may be implemented, according to one embodiment of the present invention. The vehicle 200 may be, in one embodiment, any one of a number of different types of aircraft such as, for example, a private propeller or jet engine driven airplane, a commercial jet liner, or a helicopter. In the depicted embodiment, the vehicle 200 includes a flight deck 202 (or cockpit) and an avionics/flight system 204. Although not specifically illustrated, it should be understood that the vehicle 200 also includes a frame or body to which the flight deck 202 and the avionics/flight system 204 are connected, as is commonly understood. It should also be noted that vehicle 200 is merely exemplary and could be implemented without one or more of the depicted components, systems, and data sources. It will additionally be appreciated that the vehicle 200 could be implemented with one or more additional components, systems, or data sources. Additionally, is should be understood that the system 10 may be utilized in vehicles other than aircraft, such as manned ground vehicles with a closed cockpits (e.g. tank or armored personnel carrier) or an open vehicles such as a Humvee class vehicle. Further, the display system 10 may be used in portable computing devices such as laptop computers and other similar mobile devices with LCD displays.

The flight deck 202 includes a user interface 206, display devices 208 (e.g., a primary flight display (PFD)), a communications radio 210, a navigational radio 212, and an audio device 214. The user interface 206 is configured to receive input from the user 211 (e.g., the pilot) and, in response to the user input, supply command signals to the avionics/flight system 204. The user interface 206 may include flight controls and any one of, or combination of, various known user interface devices including, but not limited to, a cursor control device (CCD), such as a mouse, a trackball, or joystick, and/or a keyboard, one or more buttons, switches, or knobs. In the depicted embodiment, the user interface 206 includes a CCD 216 and a keyboard 218. The user 211 uses the CCD 216 to, among other things, move a cursor symbol on the display devices 208, and may use the keyboard 218 to, among other things, input textual data.

Still referring to FIG. 1, the display devices 208, which may include the flat panel display system described above, are used to display various images and data, in graphic, iconic, and/or textual formats, and to supply visual feedback to the user 211 in response to user input commands supplied by the user 211 to the user interface 206.

The communication radio 210 is used, as is commonly understood, to communicate with entities outside the vehicle 200, such as air-traffic controllers and pilots of other aircraft. The navigational radio 212 is used to receive from outside sources and communicate to the user various types of information regarding the location of the vehicle, such as Global Positioning Satellite (GPS) system and Automatic Direction Finder (ADF) (as described below). The audio device 214 is, in one embodiment, an audio speaker mounted within the flight deck 202.

The avionics/flight system 204 includes a runway awareness and advisory system (RAAS) 220, an instrument landing system (ILS) 222, a flight director 224, a weather data source 226, a terrain avoidance warning system (TAWS) 228, a traffic and collision avoidance system (TCAS) 230, a plurality of sensors 232 (e.g., a barometric pressure sensor, a thermometer, and a wind speed sensor), one or more terrain databases 234, one or more navigation databases 236, a navigation and control system (or navigation computer) 238, and a processor 240. The various components of the avionics/flight system 204 are in operable communication via a data bus 242 (or avionics bus). Although not illustrated, the navigation and control system 238 may include a flight management system (FMS), a control display unit (CDU), an autopilot or automated guidance system, multiple flight control surfaces (e.g., ailerons, elevators, and a rudder), an Air Data Computer (ADC), an altimeter, an Air Data System (ADS), a Global Positioning Satellite (GPS) system, an automatic direction finder (ADF), a compass, at least one engine, and gear (i.e., landing gear).

The processor 240 may be any one of numerous known general-purpose microprocessors or an application specific processor that operates in response to program instructions. In the depicted embodiment, the processor 240 includes on-board RAM (random access memory) 244 and on-board ROM (read only memory) 246. The program instructions that control the processor 240 may be stored in either or both the RAM 244 and the ROM 246. For example, the operating system software may be stored in the ROM 246, whereas various operating mode software routines and various operational parameters may be stored in the RAM 244. It will be appreciated that this is merely exemplary of one scheme for storing operating system software and software routines, and that various other storage schemes may be implemented. It will also be appreciated that the processor 240 may be implemented using various other circuits, not just a programmable processor. For example, digital logic circuits and analog signal processing circuits could also be used.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing the exemplary embodiment or exemplary embodiments. It should be understood that various changes can be made in the function and arrangement of elements without departing from the scope of the invention as set forth in the appended claims and the legal equivalents thereof.

What is claimed is:

1. A method for displaying an image on a display device having a first light source and a second light source provided in each of a first zone and a second zone, the method comprising:

providing a video signal to the display device, the video signal comprising a plurality of frames, each frame comprising first and second sub-frames corresponding to the respective first and second light sources of the first zone;

operating the first light source of the first zone for a first duration during the first sub-frame of each of the plurality of frames;

operating the second light source of the first zone for a second duration during the second sub-frame of each of the plurality of frames, the second duration being different than the first duration; and synchronizing an occurrence of the first duration with an occurrence of a second duration of an operation of the second light source of the second zone.

2. The method of claim 1, wherein the first light source emits light within a first frequency band and the second light source emits light within a second frequency band, the second frequency band being different than the first frequency band.

3. The method of claim 2, further comprising generating an image with the light emitted from the first and second light sources with an image source based on the video signal.

4. The method of claim 3, wherein the light emitted from the first light source has a first value of a radiant property and the light emitted from the second light source has a second value of the radiant property.

5. The method of claim 4, further comprising:

determining a difference between the first and second values of the radiant property; and determining the first and second durations based on the difference between the first and second values of the radiant property.

6. The method of claim 5, wherein the display device comprises a third light source and each frame of the video signal comprises a third sub-frame corresponding to the third light source, and further comprising operating the third light source for a third duration during the third sub-frame of each of the plurality of frames, the third duration being different than the first duration.

7. The method of claim 6, wherein the third light source emits light within a third frequency band and having a third value of the radiant property during said operation, the third frequency band being different than the first frequency band and the second frequency band, and wherein the image is further generated by the image source with the light emitted from the third light source.

8. The method of claim 7, further comprising:

determining a difference between the first and third values of the radiant property;

determining a difference between the second and third values of the radiant property; and determining the third duration based on the differences amongst the first, second, and third values of the radiant property.

9. The method of claim 8, wherein the first, second, and third light sources comprise respective first, second, and third pluralities of light emitters, the image source comprises a plurality of pixels, and said generation of the image with the image source comprises configuring the plurality of pixels.

10. A method for displaying an image on a display device having first, second, and third light emitters provided in each of a first zone and a second zone, and an imaging device, the method comprising:

providing a video signal to the display device, the video signal comprising a plurality of frames, each frame comprising first, second, and third sub-frames corresponding to the respective first, second, and third light emitters of the first zone;

operating the first light emitter of the first zone for a first duration during the first sub-frame of each of the plurality of frames;

operating the second light emitter of the first zone for a second duration during the second sub-frame of each of the plurality of frames, the second duration being different than the first duration;

operating the third light emitter of the first zone for a third duration during the third sub-frame of each of the plurality of frames, the third duration being different than the first and second durations;

synchronizing an occurrence of the first duration with an occurrence of a second duration of an operation of the second light source of the second zone; and generating an image with the light emitted from the first, second, and third light emitters during the respective first, second, and third durations with the imaging device.

11. The method of claim 10, wherein the light emitted from the first, second, and third light emitters has respective first, second, and third values of a radiant property and further comprising:

determining differences amongst the first, second, and third values of the radiant property; and determining the first, second, and third durations based on the differences amongst the first, second, and third values of the radiant property.

12. The method of claim 11, wherein the first, second, and third light emitters comprise respective pluralities of first, second, and third light emitters, the imaging device comprises a plurality of pixels, and said generation of the image with the imaging device comprises configuring the plurality of pixels.

13. The method of claim 12, wherein the image device is a liquid crystal display (LCD) panel.

14. A display device system, comprising:

a backlight comprising first and second light emitters provided in each of a first zone and a second zone;

an image source coupled to the backlight and configured to generate an image with light emitted from the first and second light emitters; and a controller coupled to the backlight and the image source, the controller being configured to:

provide a video signal to the backlight and the image source, the video signal comprising a plurality of frames, each frame comprising first and second sub-frames corresponding to the respective first and second light emitters of the backlight of the first zone;

operate the first light emitter for a first duration during the first sub-frame of each of the plurality of frames of the first zone;

operate the second light emitter for a second duration during the second sub-frame of each of the plurality of frames, the second duration being different than the first duration; and synchronize an occurrence of the first duration with an occurrence of a second duration of an operation of the second light source of the second zone.

15. The system of claim 14, wherein the first light emitter is configured to emit light within a first frequency band during said operation and the second light emitter is configured to emit light within a second frequency band during said operation, the second frequency band being different than the first frequency band, and wherein the light emitted from the first light emitter has a first value of a radiant property, the light emitted from the second light emitter has a second value of the radiant property, and the first and second durations are based on a difference between the first and second values of the radiant property.

16. The system of claim 15, wherein the backlight comprises a third light emitter and each frame of the video signal comprises a third sub-frame corresponding to the third light emitter, and wherein the controller is further configured to operate the third light emitter for a third duration during the third sub-frame of each of the plurality of frames, the third duration being different than the first duration.

17. The system of claim 16, wherein at least some of the first, second, and third light emitters are light emitting diodes (LEDs) and wherein the image source is an liquid crystal display (LCD) comprising a plurality of pixels.

* * * * *